US011401727B1

(12) United States Patent
Shirley

(10) Patent No.: US 11,401,727 B1
(45) Date of Patent: Aug. 2, 2022

(54) PORTABLE HUNTING BLIND SYSTEM

(71) Applicant: Charles Shirley, Magnolia, TX (US)

(72) Inventor: Charles Shirley, Magnolia, TX (US)

( * ) Notice: Subject to any disclaimer, the term of this patent is extended or adjusted under 35 U.S.C. 154(b) by 0 days.

(21) Appl. No.: 17/184,339

(22) Filed: Feb. 24, 2021

(51) Int. Cl.

| | |
|---|---|
| ***E04H 15/00*** | (2006.01) |
| ***E04H 15/44*** | (2006.01) |
| ***E04H 15/54*** | (2006.01) |
| ***E04H 15/06*** | (2006.01) |
| ***E04H 15/38*** | (2006.01) |

(52) U.S. Cl.
CPC ..... *E04H 15/001* (2013.01); *E04H 15/06* (2013.01); *E04H 15/38* (2013.01); *E04H 15/44* (2013.01); *E04H 15/54* (2013.01)

(58) Field of Classification Search
CPC ..... E04H 15/001; A01M 31/025
See application file for complete search history.

(56) References Cited

U.S. PATENT DOCUMENTS 4,950,017 A * 8/1990 Norton ..... B62J 17/08 296/102
5,058,943 A * 10/1991 Louderback ..... B60J 7/1278 296/107.09
5,174,622 A * 12/1992 Gutta ..... B62K 5/01 296/78.1
5,720,312 A * 2/1998 Scheuermann ..... E04H 15/48 52/656.1
6,105,721 A * 8/2000 Haynes ..... A01M 31/025 182/127
6,206,446 B1 * 3/2001 Slayden ..... B62K 5/01 296/102
6,439,645 B1 * 8/2002 Pedersen ..... E04H 15/06 135/88.13
6,802,327 B2 * 10/2004 Koss ..... E04H 15/38 296/159
6,910,492 B1 * 6/2005 Stuck ..... E04H 15/06 296/161
6,962,221 B1 * 11/2005 Carrette ..... E04H 15/001 297/344.21
7,523,976 B1 * 4/2009 Severson ..... B60J 7/10 296/107.13
D690,257 S * 9/2013 Willis ..... D12/404
9,394,718 B1 * 7/2016 Hill ..... E04H 15/001
10,612,265 B1 * 4/2020 Walter ..... E04H 15/001
2002/0179133 A1 * 12/2002 Abbinante ..... E04H 15/001 135/124
2004/0050410 A1 * 3/2004 DeLong ..... E04H 15/40 135/88.13

(Continued)

*Primary Examiner* — David R Dunn
*Assistant Examiner* — Danielle Jackson

(57) ABSTRACT

A portable hunting blind system is provided comprising a hunting blind having a plurality of frame members supporting a blind cover. Each of the plurality of frame members may terminate at one or more pivot joints and the blind cover may comprise a plurality of windows each defined by a flap and a coupling seam. The hunting blind may transition between an active state, a transitional state and an inactive state. In the active state, each of the plurality of frame members may be disposed relative one another about the one or more pivot joints at an angle between 15 and 180 degrees. In the inactive state, each of the plurality of frame members may be disposed relative one another about the one or more pivot joints at an angle between 0 and 15 degrees.

20 Claims, 5 Drawing Sheets

(56) References Cited

U.S. PATENT DOCUMENTS

2012/0211042 A1* 8/2012 Richter ..... E04H 15/001
135/143
2013/0306121 A1* 11/2013 Hung Lau ..... A01M 31/025
135/117

* cited by examiner

PORTABLE HUNTING BLIND SYSTEM

BACKGROUND OF THE INVENTION

In recent years, upwards of 15 million individual hunting licenses were bought on an annual basis according to United States national hunting license data. The total economic impact of the sporting arms and ammunition industry has been estimated to top $60 billion in the United States. The average annual household expenditure on hunting and fishing gear is above $37 in the United States.

Further, the terrain traversed by hunters is often amenable to transport by an all-terrain vehicle. Accordingly, it is estimated that nearly 10% of all households in the United States own some form of an all-terrain vehicle. However, when a hunter travels to a desired hunting location using their all-terrain vehicle, both the hunter and the all-terrain vehicle do not blend in with the natural environment and so are visually exposed to the target animals being hunted. Therefore, use of an all-terrain vehicle may not be advantageous for a hunter stalking target animals.

In order to better blend into the surrounding natural environment, hunters often use a hunting blind. However, typical hunting blinds may be incorporated into a platform, chair or other similar stationary apparatus and the like. If using an all-terrain vehicle, a hunter cannot transport any of the aforementioned stationary hunting blind apparatuses, but rather would have to utilize a portable version of the same. Further, the portable hunting blind must have the capability of being transported on the all-terrain vehicle while also having the capability of being iteratively and securely deployed from the all-terrain vehicle and stored securely back within the all-terrain vehicle.

Accordingly, it would be advantageous to provide a hunting blind that is portable via an all-terrain vehicle. Further, it would be advantageous to utilize a hunting blind that is easily deployable from an all-terrain vehicle. Similarly, it would be advantageous to utilize a hunting blind that is easily stored within or upon the all-terrain vehicle. Moreover, it would be advantageous to provide a hunting blind that may be utilized by a hunter upon the all-terrain vehicle or may be utilized separately from the all-terrain vehicle after detachment therefrom.

DETAILED DESCRIPTION OF THE INVENTION

Figure 1A:
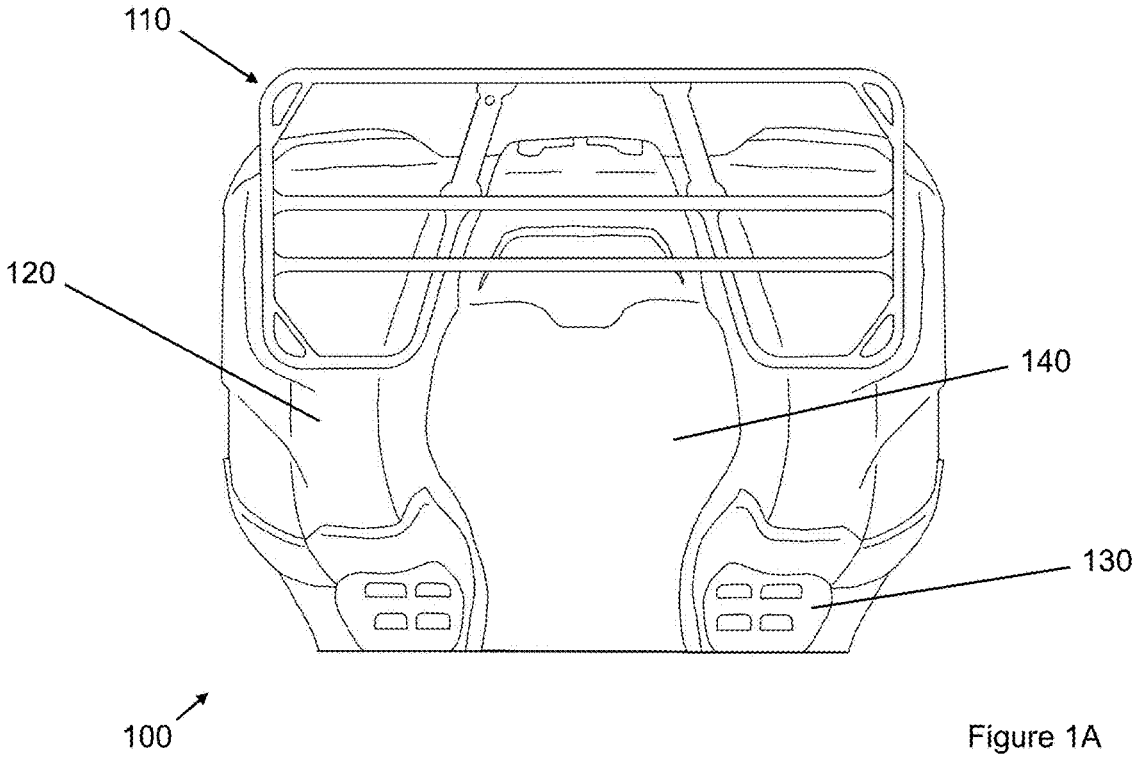
FIG. 1A is an overhead view of an all-terrain vehicle in accordance with some embodiments of the present invention.

Before describing the present invention in detail, it is to be understood that the invention is not limited to any one of the particular embodiments, which of course may vary. It is also to be understood that the terminology used herein is for the purpose of describing particular embodiments only, and therefore is not necessarily intended to be limiting. As used in this specification and the appended claims, terms in the singular and the singular forms "a," "an," and "the" include plural referents unless the context clearly dictates otherwise. Thus, for example, reference to "a portable hunting blind system" also includes a plurality of portable hunting blind systems, and the like.

In some embodiments, a portable hunting blind system is provided, comprising a hunting blind, wherein the hunting blind comprises a plurality of frame members supporting a blind cover, wherein each of the plurality of frame members terminate at one or more pivot joints, wherein the blind cover comprises a plurality of windows; and a coupling substrate, wherein the plurality of frame members couple to the coupling substrate.

In some embodiments, the plurality of frame members couple to the coupling substrate via one or more base support members.

In some embodiments, the hunting blind transitions between an active state, a transitional state and an inactive state.

In some embodiments, when the plurality of frame members support the blind cover while the hunting blind is in the active state, the blind cover comprises a plurality of planar sides.

In some embodiments, at least three of the plurality of planar sides comprise at least one window of the plurality of windows.

In some embodiments, in the active state, each of the plurality of frame members are disposed relative one another about the one or more pivot joints at an angle between 15 and 180 degrees.

In some embodiments, in the inactive state, each of the plurality of frame members are disposed relative one another about the one or more pivot joints at an angle between 0 and 15 degrees.

In some embodiments, the coupling substrate comprises one or more structural elements of an all-terrain vehicle.

In some embodiments, the plurality of windows are each defined by a flap and a coupling seam.

In some embodiments, each of the plurality of frame members comprises at least one horizontal portion coupled between at least two vertical portions.

In some embodiments, each of the at least two vertical portions terminate at a pivot joint of the one or more pivot joints.

In some embodiments, the plurality of frame members are fabricated from one or more materials selected from: a polymer plastic, steel, a steel alloy, carbon fiber, aluminum, an aluminum alloy or any combination thereof.

In some embodiments, the blind cover is fabricated from one or more materials selected from: polyurethane laminate, thermoplastic polyurethane, nylon, polyester, PVC-coated polyester, terylene, laminated cotton, laminated poplin, enameled cloth, polyester fleece, polyester microfiber, silk, cotton, wool, plush, vinyl, pleather, plastic, micro denier filament yarns or any combination thereof.

In some embodiments, a portable hunting blind system is provided comprising a hunting blind comprising a plurality of frame members supporting a blind cover, wherein each of the plurality of frame members terminate at one or more pivot joints, and wherein the blind cover comprises a plurality of windows each defined by a flap and a coupling seam, wherein the hunting blind transitions between an active state, a transitional state and an inactive state, wherein, in the active state, each of the plurality of frame members are disposed relative one another about the one or more pivot joints at an angle between 15 and 180 degrees, and wherein, in the inactive state, each of the plurality of frame members are disposed relative one another about the one or more pivot joints at an angle between 0 and 15 degrees; and a coupling substrate, wherein the plurality of frame members couple to the coupling substrate.

In some embodiments, a portable hunting blind system is provided comprising a hunting blind comprising a plurality of frame members supporting a blind cover, wherein the blind cover comprises a plurality of windows each defined by a flap and a coupling seam, wherein each of the plurality of frame members terminate at one or more pivot joints, wherein each of the plurality of frame members comprises at least one horizontal portion coupled between at least two vertical portions, and wherein each of the at least two vertical portions terminate at a pivot joint of the one or more pivot joints, wherein the hunting blind transitions between an active state, a transitional state and an inactive state, wherein, in the active state, each of the plurality of frame members are disposed relative one another about the one or more pivot joints at an angle between 15 and 180 degrees, wherein, when the plurality of frame members support the blind cover while the hunting blind is in the active state, the blind cover comprises a plurality of planar sides, and wherein at least three of the plurality of planar sides comprise at least one window of the plurality of windows, wherein, in the inactive state, each of the plurality of frame members are disposed relative one another about the one or more pivot joints at an angle between 0 and 15 degrees; and a coupling substrate comprising one or more structural elements of an all-terrain vehicle, wherein the plurality of frame members couple to the coupling substrate via one or more base support members.

Exemplary embodiments of the present invention are illustrated in the accompanying figures. As shown in FIG. 1A, a portable hunting blind system 100 may utilize a portion of an all-terrain vehicle is illustrated. Specifically, the portion of the all-terrain vehicle provided comprises a storage rack 110 coupled to a vehicle body 120. Further, the vehicle body 120 supports a plurality of foot traction panels 130 as well as a seat 140.

When using the all-terrain vehicle, a user (not shown) sits on the seat 140 and places their feet upon the respective foot traction panels 130 while stowing goods on the storage rack 110. While the all-terrain vehicle further comprises a handle pipe, fuel tank, bumper carrier, electric system, muffler, carburetor, air cleaner, engine, steering system, brake system, support frame, transmission system, plurality of wheels, handlebars and the like, only relevant portions of the all-terrain vehicle are illustrated in FIG. 1A.

Figure 1B:
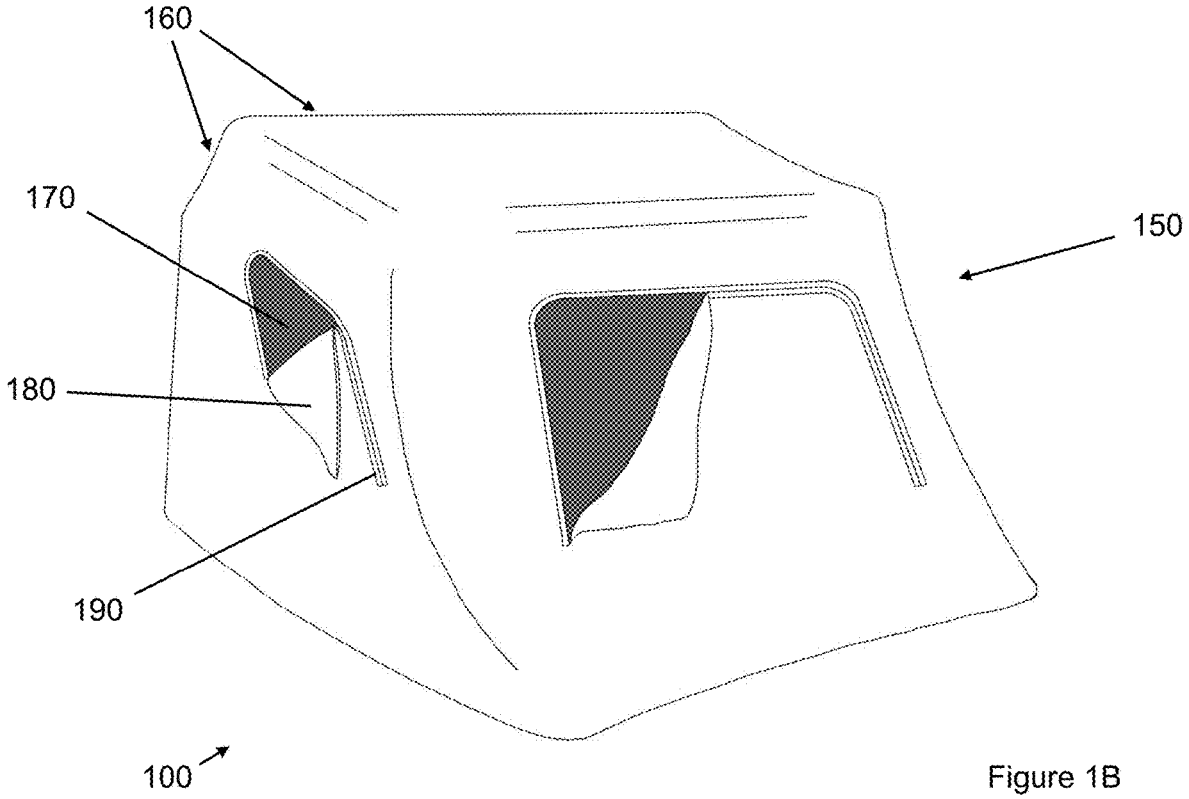
FIG. 1B is an overview of a portable hunting blind system in accordance with some embodiments of the present invention.

As shown in FIG. 1B, a portable hunting blind system 100 is illustrated. Specifically, the portable hunting blind system 100 utilizes a hunting blind 150 that comprises a plurality of substantially planar sides 160 defined by an associated number of frame members (not shown) disposed under a cover material of the hunting blind 150. The plurality of substantially planar sides 160 may be planar in nature or, alternatively, may have a non-zero curvature due to the hunting blind 150 cover material being slack over the frame members.

Further, the hunting blind 150 comprises a plurality of windows 170 that may be exposed via associated flaps 180 that may be detached from a body of the hunting blind 150 via a coupling mechanism 190. The flaps 180 may be coupled to the hunting blind 150 body via a seam that comprises at least a portion of the coupling mechanism 190. The seam may run along the outer extent of the windows 170. The flaps 180 may be continuous with the cover material of the hunting blind 150 body and therefore be made of the same material as shown in FIG. 1B.

The coupling mechanism 190 may be any suitable means of removably securing the flaps 180 to the seam of the hunting blind 150 body. For example, the coupling mechanism 190 may comprise one or more zippers, hook and loop fastener portions, magnets, buttons, snaps, clasps, ties and the like or any combination thereof. Further, the coupling mechanism 190 may allow for only a portion of a given window 170 to be exposed as shown in FIG. 1B.

Each of the plurality of windows 170 reveals an internal cavity contained within the body of the hunting blind 150. Specifically, the plurality of substantially planar sides 160 define the internal cavity contained within the body of the hunting blind 150. When in use, a user may occupy the internal cavity of the hunting blind 150 in order to access the windows 170 for purposes of hunting a desired target animal. The ability of the windows 170 to be partially exposed enables the user to maintain optimal camouflage with the surrounding environment while still having an unobstructed opening through which to shoot the desired target animal.

The one or more materials used to fabricate the hunting blind 150 cover and flaps 180 may be weatherproof and/or waterproof in nature to provide environmental protection to the all-terrain vehicle and the user. Specifically, the weatherproof and/or waterproof materials may include, but are not limited to, polyurethane laminate, thermoplastic polyurethane, nylon, polyester, PVC-coated polyester, terylene, laminated cotton, laminated poplin, enameled cloth, polyester fleece, polyester microfiber, silk, cotton, wool, plush, vinyl, pleather, plastic, micro denier filament yarns and the like or any combination thereof.

Further, the one or more materials used to fabricate the hunting blind 150 cover and flaps 180 may utilize an aesthetic design that allows both the user and the all-terrain vehicle to blend in with a surrounding environment where the desired target animal is located. The aesthetic design may be chosen for a given surrounding environment or season such as desert, alpine, prairie, forest etc. or spring, summer, fall, winter and the like.

Additionally, both the hunting blind 150 cover and the frame members supporting it thereunder may comprise a form factor allowing accommodation of either single-seat and two-seat all-terrain vehicle models. Moreover, both the hunting blind 150 cover and the frame members may be utilized by a user in a stand-alone manner with a tripod stand, a quad stand and/or as a ground blind setup. It is to be understood that the portable hunting blind system 100 is modular in nature and therefore may be selectively utilized with the all-terrain vehicle, the tripod stand, the quad stand and as a ground blind setup according to the desire of the user. Each of the all-terrain vehicle, the tripod stand, the quad stand and/or the ground may be utilized as coupling substrates for the portable hunting blind system. Further, any subpart or structural element of the all-terrain vehicle, the tripod stand, the quad stand and/or the ground may be utilized as coupling substrates for the portable hunting blind system.

Figure 2A:
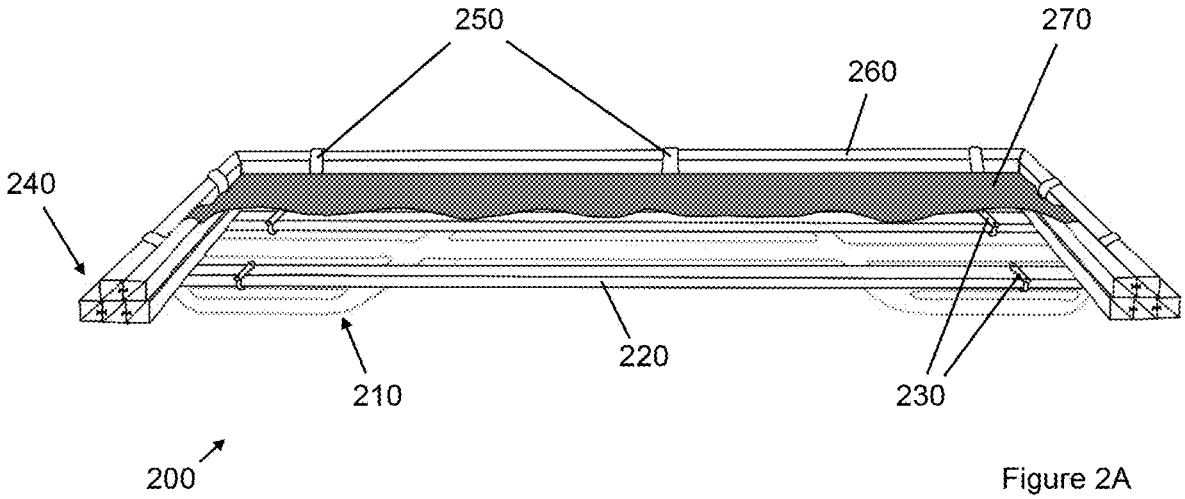
FIG. 2A is an overview of a portable hunting blind system in an inactive state in accordance with some embodiments of the present invention.
Figure 2B:
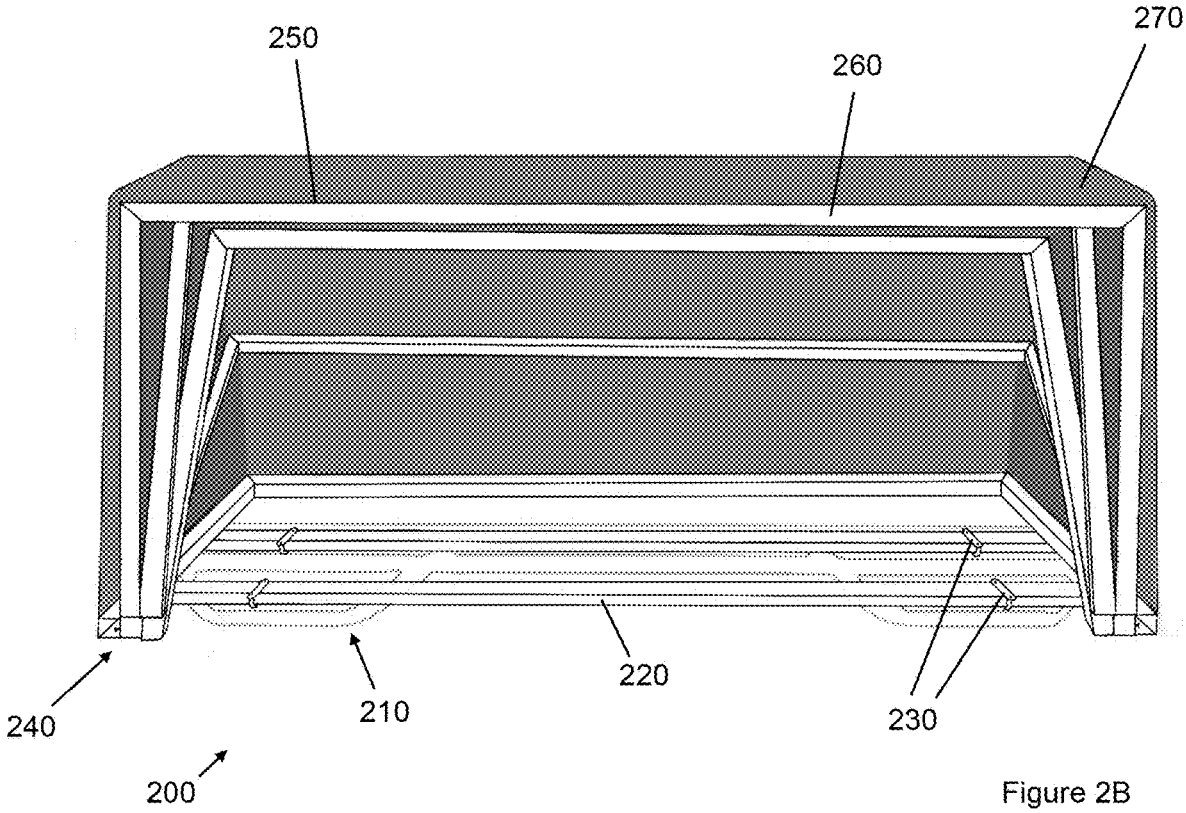
FIG. 2B is an overview of a portable hunting blind system in a transitional state between an active state and an inactive state.

As shown in FIGS. 2A and 2B, a portable hunting blind system 200 is provided. The system 200 may be manipulated by a user iteratively between an inactive state illustrated in FIG. 2A and an active state illustrated in FIG. 2B. The portable hunting blind system 200 of FIG. 2A in the inactive state is coupled to a storage rack 210 of an all-terrain vehicle at a first end of a hunting blind comprising a plurality of base support members 220. An associated plurality of retention elements 230 are utilized to secure the base support member 220 to the storage rack 210.

The storage rack 210 may be made from one or more materials that allow for structural robustness against high winds, extreme accelerations, small impacts from tree branches and the like. Further, the one or more materials utilized to fabricate the storage rack 210 may include, but are not limited to, robust polymer plastics, stainless steel and similar alloys, carbon fiber, aluminum and the like or any combination thereof.

Further, in the example where the storage rack 210 is coupled to a rear portion of the all-terrain vehicle, the rear portion may comprise a storage compartment thereunder that allows for the portable hunting blind system 200 to be stowed therein. Specifically, a hatch hingedly coupled to the all-terrain vehicle body may be pivoted open to reveal the storage compartment. Pivot joints 240 of the portable hunting bind system 200 may allow for it to be manipulated into the exposed storage compartment. Thereafter, the hatch may be pivoted back into its closed position covering the storage compartment once again.

The base support members 220 may be made from one or more materials that allow for structural robustness against high winds, extreme accelerations, small impacts from tree branches and the like. Similarly, the one or more materials utilized to fabricate the base support members 220 may include, but are not limited to, robust polymer plastics, stainless steel and similar alloys, carbon fiber, aluminum and the like or any combination thereof.

The retention elements 230 may be any suitable structure that secures the storage rack 210 to the base support members 220. The retention elements 230 may be structurally unitary with the storage rack 210 or the retention elements 230 may be structurally unitary with the base support members 220. Alternatively, the retention elements 230 may be structurally discontinuous, separate and distinct from both the storage rack 210 and the base support members 220.

Further, the retention elements 230 may removably couple the storage rack 210 to the base support members 220. The retention elements 230 may comprise a plurality of structural members each iteratively removable from one another. Specifically, the retention elements 230 may comprise one or more of threaded U-bolts, clasps, straps, buckles, clamps, tension belts and the like or any combination thereof.

The base support members 220 may be coupled directly to a plurality of frame members 260, where each frame member 260 terminates at a pair of pivot joints 240. The frame members 260 are shaped to support a hunting blind cover 270 as it is pulled up and over a user as shown in FIG. 2B. The pair of pivot joints 240 allow each of the frame members 260 to pivot about respective single points in order to allow the hunting blind cover 270 to be pulled up and over the user. Each pivot joint 240 may utilize one or more of hinges, rotation shafts, threaded bolts, threaded nuts and the like or any combination thereof.

The frame members 260 may be coupled to a hunting blind cover 270 via a plurality of attachment elements 250. The plurality of attachment elements 250 may allow for removable coupling of the hunting blind cover 270 to the frame members 260 so that the hunting blind cover 270 may be modularly replaced. Alternatively, the hunting blind cover 270 may be structurally unitary and/or permanently coupled to the frame members 260 and thereby the attachments elements 270 may be rendered unnecessary.

The frame members 260 may be made from one or more materials that allow for structural robustness against high winds, extreme accelerations, small impacts from tree branches and the like while still minimizing the weight of the frame members 260. The one or more materials utilized to fabricate the frame members 260 may include, but are not limited to, robust polymer plastics, stainless steel and similar alloys, carbon fiber, aluminum and the like or any combination thereof.

The one or more materials used to fabricate the hunting blind cover 270 may be weatherproof and/or waterproof in nature to provide environmental protection to the all-terrain vehicle and the user. Specifically, the weatherproof and/or waterproof materials may include, but are not limited to, polyurethane laminate, thermoplastic polyurethane, nylon, polyester, PVC-coated polyester, terylene, laminated cotton, laminated poplin, enameled cloth, polyester fleece, polyester microfiber, silk, cotton, wool, plush, vinyl, pleather, plastic, micro denier filament yarns and the like or any combination thereof.

Further, the one or more materials used to fabricate the hunting blind cover 270 may utilize an aesthetic design that allows both the user and the all-terrain vehicle to blend in with a surrounding environment where the desired target animal is located. The aesthetic design may be chosen for a given surrounding environment or season such as desert, alpine, prairie, forest etc. or spring, summer, fall, winter and the like.

The attachment elements 250 are shown in FIG. 2A as structurally being disposed around the frame members 260 in order to couple the hunting blind cover 270 thereto. Specifically, the attachment elements 250 may comprise one or more of hook and loop fastener portions, belts, loops, straps, fasteners, clasps, tensioners, adhesives, magnets and the like or any combination thereof. Further, the attachment elements 250 may be structurally unitary with the frame members 260 or the attachment elements 250 may be structurally unitary with the hunting blind cover 270. Alternatively, the attachment elements 250 may be structurally discontinuous, separate and distinct from both the frame members 260 and the hunting blind cover 270.

As shown in FIG. 2B, the portable hunting blind system 200 is shown to be in a transitional state between an active state and an inactive state. Each of the frame members 260 are disposed adjacent one another in the inactive state as shown in FIG. 2A, whereas each of the frame members 260 extend away from one another in the active state. The rotational degree of freedom provided by each of the pivot joints 240 allow for the frame members 260 to extend away from one another as the portable hunting blind system 200 transitions from inactive to active states and vice versa in an iterative manner. Specifically, each pivot joint 240 of the portable hunting blind system 200 may allow a rotational range of between 0 degrees and 180 degrees. Further, each pivot joint 240 may allow each of the frame members 260 to rotate within a rotational range relative one another of between 0 degrees and 180 degrees.

The attachment elements 250 in FIG. 2B are shown to be flush with the frame members 260 and the hunting blind cover 270. In such a configuration, the attachment elements 250 may be substantially planar in structure which may comprise one or more of hook and loop fastener portions, belts, loops, straps, fasteners, clasps, tensioners, adhesives, magnets and the like or any combination thereof. Further, this configuration allows for a more streamlined attractive aesthetic appearance of the hunting blind cover 270 while also providing a smaller form factor that presents entanglement with environmental elements.

Moreover, as the portable hunting blind system 200 transitions to the active state, the hunting blind cover 270 becomes taut over the frame members 260. In the inactive state, as the frame members 260 are disposed adjacent one another, the material of the hunting blind cover 270 may bunch up together. To combat this, the hunting blind cover 270 may comprise one or more crease folds to allow the cover 270 material to easily fold together without bunching up.

Further, while the frame members 260 transition from the inactive state to the active state, the frame members 260 transition from being disposed adjacent one another to being disposed separate from one another. Specifically, in the active state, the frame members 260 may be disposed equidistant from one another, thus holding the hunting blind cover 270 in an equally taut configuration across each of the frame members 260. Moreover, the frame member 260 disposed at a first end of the hunting blind system 200 and coupled to the base support members 220 may be disposed parallel to the frame member 260 disposed at a second end opposite the first end of the hunting blind system 200 when the hunting blind system 200 is fully disposed in the active state.

Accordingly, in the active state with the first end frame member 260 disposed parallel to the second end frame member 260, all frame members 260 disposed therebetween may be disposed equidistant relative one another. Specifically, if four frame members 260 are utilized, the first end frame member 260 may be disposed at the zero degree angle, the second end frame member 260 may be disposed at the 180 degree angle and the two frame members 260 disposed therebetween may be disposed at the 60 degree angle and the 120 degree angle, respectively.

Alternatively, the frame members 260 disposed between the first and second end frame members 260 may not be equidistant from one another but rather may be disposed in such a manner as to allow for the windows 170, flaps 180 and coupling mechanisms 190 illustrated in FIG. 1B. Specifically, if four frame members 260 are utilized, the first end frame member 260 may be disposed at the zero degree angle, the second end frame member 260 may be disposed at the 180 degree angle and the two frame members 260 disposed therebetween may be disposed at the 75 degree angle and the 105 degree angle, respectively.

Figure 3:
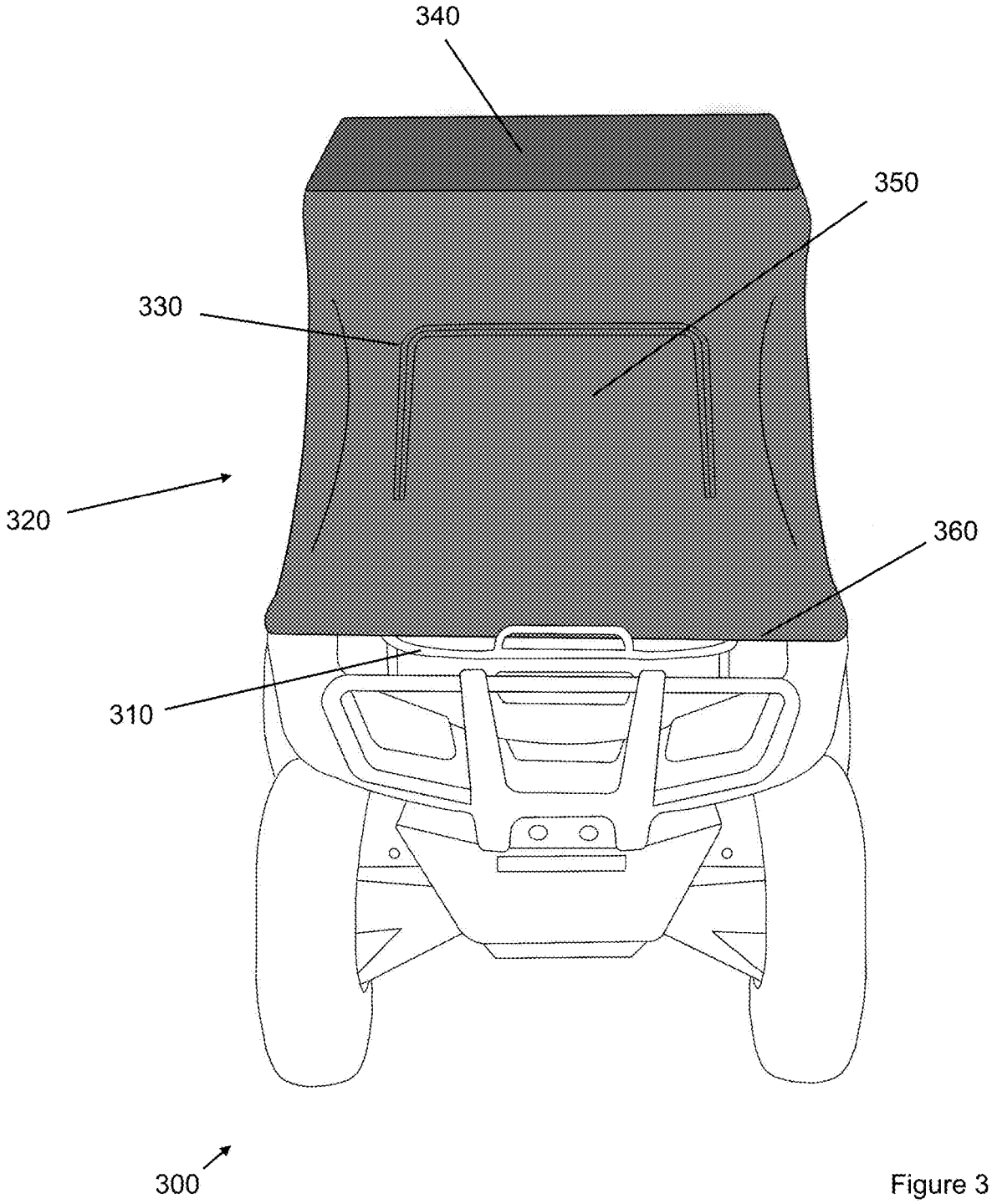
FIG. 3 is an overview of a portable hunting blind system in an active state in accordance with some embodiments of the present invention.

As shown in FIG. 3, a portable hunting blind system 300 in an active state is provided. The system 300 may comprise a front storage rack 310 that may be utilized to couple a hunting blind cover 320 to an all-terrain vehicle as illustrated in FIG. 3. The hunting blind cover 320 may comprise a coupling seam 330, a plurality of exterior sides 340, a window flap 350 and one or more cover couplings 360. The coupling seam 330 removably attaches the window flap 350 to the remainder of the hunting blind cover 320 material.

The hunting blind system 300 comprises a plurality of exterior sides 340 which may each be substantially planar when the hunting blind cover 320 is taut or slightly curved when the hunting blind cover 320 is slack. Further, each of the plurality of exterior sides 340 may comprise a coupling seam 330 and a window flap 350. Moreover, the hunting blind cover 320 may comprise any suitable number of exterior sides 340 but preferably comprises at least five sides, and more preferably at least six sides.

As illustrated in FIG. 3, the hunting blind cover 320 may comprise a first end disposed adjacent a rear of the all-terrain vehicle and a second end disposed adjacent a front of the all-terrain vehicle. The cover couplings 360 may secure the second end of the hunting blind cover 320 to the front of the all-terrain vehicle upon the cover 320 transitioning from the inactive to the active state. Specifically, the cover couplings 360 may comprise one or more of hook and loop fastener portions, belts, loops, straps, fasteners, clasps, tensioners, adhesives, magnets and the like or any combination thereof. Additionally, the cover couplings 360 may removably couple the first end of the hunting blind cover 320 to the rear storage rack at the rear portion of the all-terrain vehicle.

Figure 4:
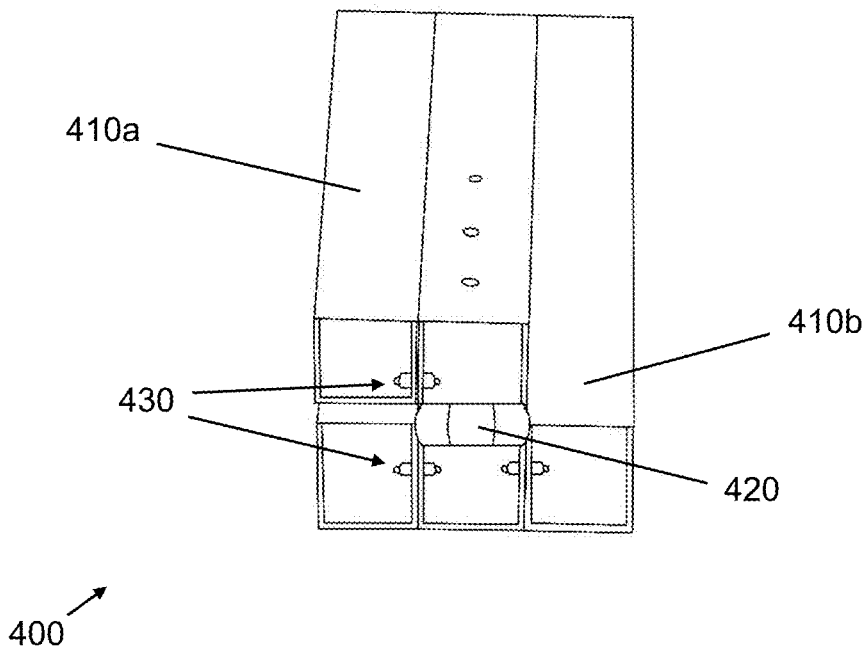
FIG. 4 is a detailed view of a pivot joint of a portable hunting blind system in accordance with some embodiments of the present invention.

As shown in FIG. 4, a pivot joint 400 of a portable hunting blind system is provided. The pivot joint 400 may comprise a plurality of frame members 410 coupled together via a hinge 420 and a plurality of rotational fasteners 430. Specifically, a first plurality of frame members 410*a* are coupled together in a first row via a first set of rotational fasteners 430 and a second plurality of frame members 410*b* are coupled together in a second row via a second set of rotational fasteners 430 as illustrated in detail in FIG. 4.

Further, the hinge 420 may be utilized to rotationally couple together the first and second set of frame members 410*a*, 410*b* as wholes as opposed to individual frame members 410. Alternatively, one or more hinges 420 may be utilized to rotationally couple together individual frame members 410 such that each individual frame members 410 may rotate independent relative one another. Moreover, each of the individual frame members 410 in the first set of frame members 410*a* may rotate relative one another via the first set of rotational fasteners 430.

Each of the rotational fasteners 430 may comprise any suitable structure that is capable of coupling together individual frame members 410 while also allowing the individual frame members 410 to rotate relative one another. Specifically, each of the rotational fasteners 430 may comprise a central shaft and a fastening mechanism. The central shaft may be generally cylindrical in nature allowing the adjoining frame members 410 to rotate relative one another and relative the fastener 430. The fastening mechanism may be attached on either end of the central shaft and thus securing the frame members 410 together.

Each pivot joint 400 may utilize one or more of hinges, rotation shafts, threaded bolts, threaded nuts, rivets, washers, bearings, low-friction materials and the like or any combination thereof. Further, the materials utilized to fabricate the frame members 410, the hinges 420 and the rotational fasteners 430 may include, but are not limited to, robust polymer plastics, stainless steel and similar alloys, carbon fiber, aluminum and the like or any combination thereof.

Figure 5:
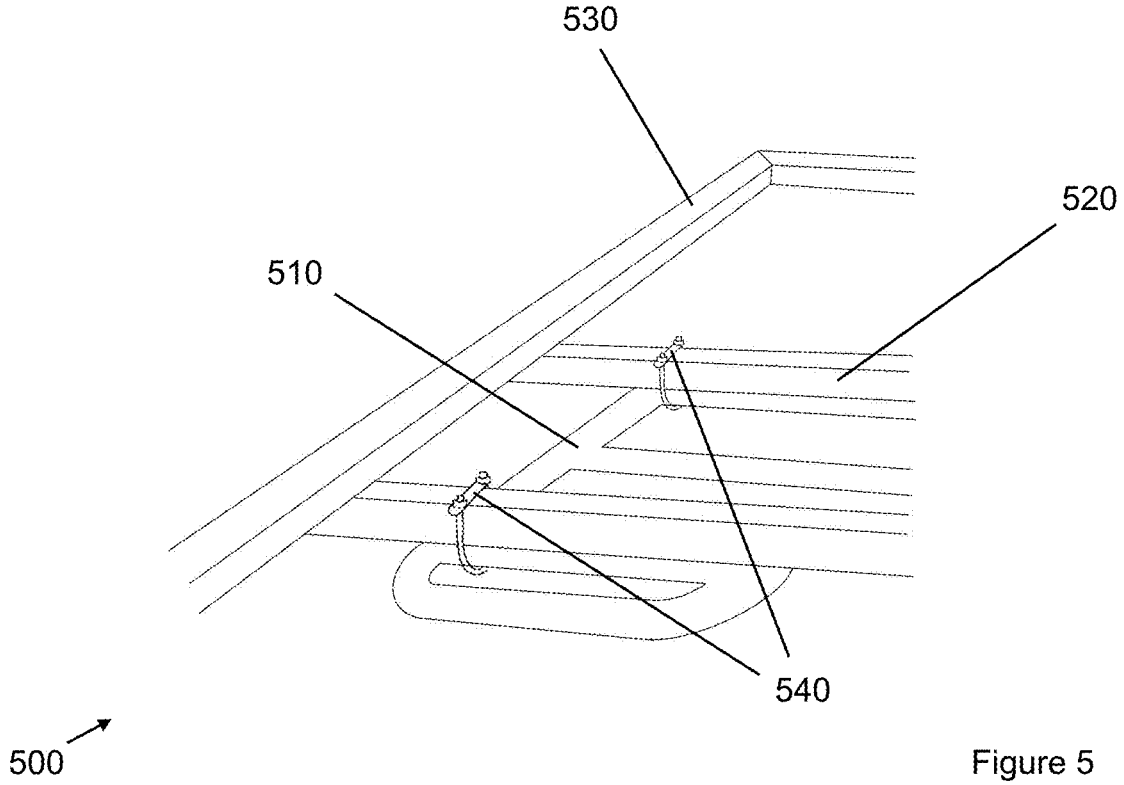
FIG. 5 is a detailed view of an anchoring system of a portable hunting blind system coupling to an all-terrain vehicle in accordance with some embodiments of the present invention.

As shown in FIG. 5, an anchoring system 500 of a portable hunting blind system coupling to an all-terrain vehicle is provided. The anchoring system may be utilized to removably couple a plurality of base support members 520 to of the portable hunting blind system to a storage rack 510 of the all-terrain vehicle. The plurality of base support members 520 are designed to support a plurality of frame members 530 of a hunting blind cover (not shown). The storage rack 510 may be disposed on a rear portion of the all-terrain vehicle, thus coupling the all-terrain vehicle to the hunting blind cover.

Further, the retention elements 540 may removably couple the storage rack 510 to the base support members 520. The retention elements 540 may comprise a plurality of structural members each iteratively removable from one another. Specifically, the retention elements 540 may comprise one or more of threaded U-bolts, clasps, straps, buckles, clamps, tension belts and the like or any combination thereof.

The retention elements 540 may be any suitable structure that secures the storage rack 510 to the base support members 520. The retention elements 540 may be structurally unitary with the storage rack 510 or the retention elements 540 may be structurally unitary with the base support members 520. Alternatively, the retention elements 540 may be structurally discontinuous, separate and distinct from both the storage rack 510 and the base support members 520.

Figure 6:
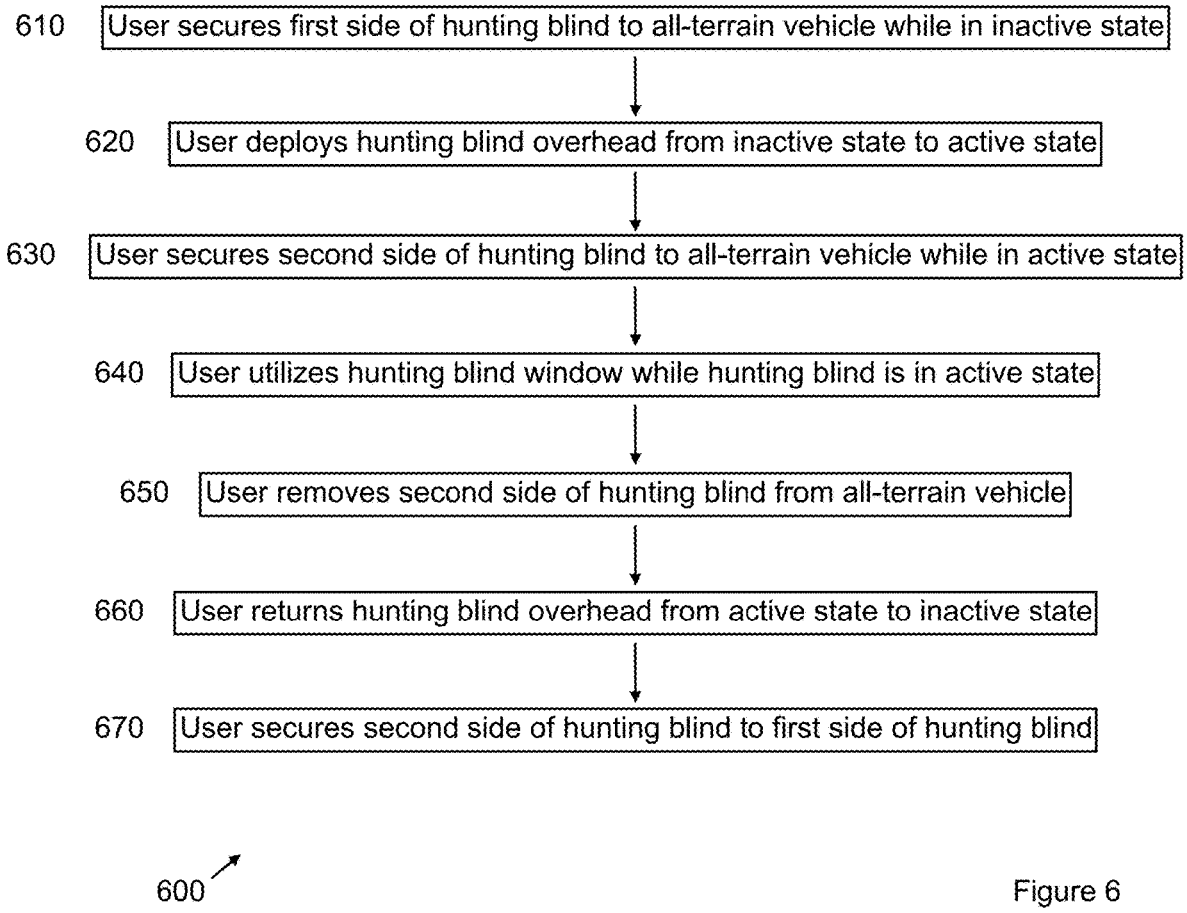
FIG. 6 is a flow chart of a process of utilizing a portable hunting blind system with an all-terrain vehicle in accordance with some embodiments of the present invention.

As shown in FIG. 6, a flow chart of a process 600 of utilizing a portable hunting blind system with an all-terrain vehicle is provided. In step 610, a user may secure a first side of a hunting blind cover to an all-terrain vehicle while the hunting blind cover is in an inactive state. In step 620, the user may deploy the hunting blind cover over the head of the user while transitioning the hunting blind cover from the inactive state to the active state. Deployment of the hunting blind cover may be performed manually by the user.

In step 630, the user may secure a second side of the hunting blind cover to the all-terrain vehicle while the hunting blind cover is in an active state. In step 640, the user may utilize a hunting blind window while the hunting blind cover is in the active state. In step 650, the user may remove the second side of the hunting blind cover from the all-terrain vehicle. In step 660, the user may return the hunting blind over the user's head from the active state back into the inactive state. In step 670, after being disposed back into the inactive state, the user may secure the second side of the hunting blind cover to the first side thereof for purposes of storage while the all-terrain vehicle is in use.

Step 610 is required when coupling the hunting blind cover to the all-terrain vehicle. However, the user may only need to couple the hunting blind to the vehicle when the user first uses the portable hunting blind system or when the user decides to remove the hunting blind cover from the all-terrain vehicle. Therefore, step 610 may not be required to execute the process 600. Similarly, step 670 is required when desiring to secure the hunting blind cover during rigorous use of the all-terrain vehicle and so, therefore, step 670 may not be required.

Each of the steps 610-670 in the process 600 of FIG. 6 may not be required to execute the process 600 but rather may be optional in the execution thereof. Further, each of the steps 610-670 in the process 600 need not be performed in the order that they appear in FIG. 6 but rather they may be modularly reordered while still successfully executing the process 600.

Further, in the example where the storage rack is coupled to a rear portion of the all-terrain vehicle, the rear portion may comprise a storage compartment therein that allows for the portable hunting blind to be stowed therein. Specifically, a hatch hingedly coupled to the all-terrain vehicle body may be pivoted open to reveal the storage compartment. Pivot joints of the portable hunting bind may allow for it to be manipulated into the exposed storage compartment. Thereafter, the hatch may be pivoted back into its closed position covering the storage compartment once again. This process may replace step 670 of the process 600 of FIG. 6.

With regard to FIGS. 1-6, additional or substitute inventive disclosure may be relevant. For example, any reference to robust polymer plastics may include any suitable polymer material includes, but is not limited to, polyethylene, polystyrene, polypropylene, epoxy resins, phenolic resins, Acrylanitrile Butadiene Styrene (ABS), Polycarbonate (PC), Mix of ABS and PC, Acetal (POM), Acetate, Acrylic (PMMA), Liquid Crystal Polymer (LCP), Mylar, Polyamid-Nylon, Polyamid-Nylon 6, Polyamid-Nylon 11, Polybutylene Terephthalate (PBT), Polycarbonate (PC), Polyetherimide (PEI), Polyethylene (PE), Low Density PE (LDPE), High Density PE (HDPE), Ultra High Molecular Weight PE (UHMW PE), Polyethylene Terephthalate (PET), PolPolypropylene (PP), Polyphthalamide (PPA), Polyphenylenesulfide (PPS), Polystyrene (PS), High Impact Polystyrene (HIPS), Polysulfone (PSU), Polyurethane (PU), Polyvinyl Chloride (PVC), Chlorinated Polyvinyl chloride (CPVC), Polyvinylidenefluoride (PVDF), Styrene Acrylonitrile (SAN), Teflon TFE, Thermoplastic Elastomer (TPE), Thermoplastic Polyurethane (TPU), and/or Engineered Thermoplastic Polyurethane (ETPU) and the like or any combination thereof.

Additionally, both the hunting blind cover and the frame members supporting it thereunder may comprise a form factor allowing accommodation of either single-seat and two-seat all-terrain vehicle models. Moreover, both the hunting blind cover and the frame members may be utilized by a user in a stand-alone manner with a tripod stand, a quad stand and/or as a ground blind setup. Each of the all-terrain vehicle, the tripod stand, the quad stand and/or the ground may be utilized as coupling substrates for the portable hunting blind system. Further, any subpart or structural element of the all-terrain vehicle, the tripod stand, the quad stand and/or the ground may be utilized as coupling substrates for the portable hunting blind system.

It is to be understood that the portable hunting blind system is modular in nature and therefore may be selectively utilized with the all-terrain vehicle, the tripod stand, the quad stand and as a ground blind setup according to the desire of the user. While the tripod stand, the quad stand and the ground blind setup are not illustrated in FIGS. 1-6, such configurations are to be easily understood by one having ordinary skill in the art as modular replacements for the all-terrain vehicle.

The specification and drawings are to be regarded in an illustrative rather than a restrictive sense. However, it will be evident that various modifications and changes may be made thereunto without departing from the broader spirit and scope of the invention as set forth in the claims. Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a," "an," "the," and similar referents in the context of describing the disclosed embodiments (especially in the context of the following claims) are to be construed to cover both the singular and the plural, unless otherwise indicated or clearly contradicted by context. The terms "comprising," "having," "including," and "containing" are to be construed as open-ended terms (i.e., meaning "including, but not limited to,") unless otherwise noted. The term "connected," where unmodified and referring to physical connections, is to be construed as partly or wholly contained within, attached to, or joined together, even if there is something intervening. Recitation of ranges of values are merely intended to serve as a shorthand method of referring individually to each separate value falling within the range, unless otherwise indicated and each separate value is incorporated into the specification as if it were individually recited. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal.

Conjunctive language, such as phrases of the form "at least one of A, B, and C," or "at least one of A, B and C," is understood with the context as used in general to present that an item, term, etc., may be either A or B or C, or any nonempty subset of the set of A and B and C, unless specifically stated otherwise or otherwise clearly contradicted by context. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, the term "plurality" indicates a state of being plural (e.g., "a plurality of items" indicates multiple items). The number of items in a plurality is at least two, but can be more when so indicated either explicitly or by context.

The use of any examples, or exemplary language (e.g., "such as") provided, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described. Accordingly, the scope of the present disclosure includes all modifications and equivalents of the subject matter recited in the claims appended hereto as permitted by applicable law. Moreover, although above-described elements may be described in the context of certain embodiments of the specification, unless stated otherwise or otherwise clear from context, these elements are not mutually exclusive to only those embodiments in which they are described; any combination of the above-described elements in all possible variations thereof is encompassed by the scope of the present disclosure unless otherwise indicated or otherwise clearly contradicted by context.

All references, including publications, patent applications, and patents, cited are hereby incorporated by reference to the same extent as if each reference were individually and specifically indicated to be incorporated by reference and were set forth in its entirety.

The invention claimed is:

1. A portable hunting blind system, comprising:

a hunting blind comprising a plurality of frame members supporting a blind cover, wherein:

each of the plurality of frame members terminate at one or more pivot joints, wherein the blind cover comprises a plurality of windows, each of the one or more pivot joints comprise a first row of frame member terminal ends of the plurality of frame members rotationally coupled to a second row of frame member terminal ends of the plurality of frame members, the hunting blind transitions between an active state, a transitional state and an inactive state, the hunting blind in the inactive state is entirely disposed upon a rear portion surface of a vehicle, and the hunting blind in the active state extends from the rear portion surface to a front portion surface of the vehicle; and a coupling substrate, wherein the plurality of frame members couple to the coupling substrate.

2. The portable hunting blind system of claim 1, wherein the plurality of frame members couple to the coupling substrate via one or more base support members.

3. The portable hunting blind system of claim 1, wherein the hunting blind transitions between an active state, a transitional state and an inactive state.

4. The portable hunting blind system of claim 3, wherein, when the plurality of frame members support the blind cover while the hunting blind is in the active state, the blind cover comprises a plurality of planar sides.

5. The portable hunting blind system of claim 4, wherein at least three of the plurality of planar sides comprise at least one window of the plurality of windows.

6. The portable hunting blind system of claim 3, wherein, in the active state, each of the plurality of frame members are disposed relative one another about the one or more pivot joints at an angle between 15 and 180 degrees.

7. The portable hunting blind system of claim 3, wherein, in the inactive state, each of the plurality of frame members are disposed relative one another about the one or more pivot joints at an angle between 0 and 15 degrees.

8. The portable hunting blind system of claim 1, wherein the coupling substrate comprises one or more structural elements of an all-terrain vehicle.

9. The portable hunting blind system of claim 1, wherein the plurality of windows are each defined by a flap and a coupling seam.

10. The portable hunting blind system of claim 1, wherein each of the plurality of frame members comprises at least one horizontal portion coupled between at least two vertical portions.

11. The portable hunting blind system of claim 10, wherein each of the at least two vertical portions terminate at a pivot joint of the one or more pivot joints.

12. The portable hunting blind system of claim 1, wherein the plurality of frame members are fabricated from one or more materials selected from: a polymer plastic, steel, a steel alloy, carbon fiber, aluminum, an aluminum alloy or any combination thereof.

13. The portable hunting blind system of claim 1, wherein the blind cover is fabricated from one or more materials selected from: polyurethane laminate, thermoplastic polyurethane, nylon, polyester, PVC-coated polyester, terylene, laminated cotton, laminated poplin, enameled cloth, polyester fleece, polyester microfiber, silk, cotton, wool, plush, vinyl, pleather, plastic, micro denier filament yarns or any combination thereof.

14. A portable hunting blind system, comprising:

a hunting blind comprising a plurality of frame members supporting a blind cover, wherein:

each of the plurality of frame members terminate at one or more pivot joints, each of the one or more pivot joints comprise a first row of frame member terminal ends of the plurality of frame members rotationally coupled to a second row of frame member terminal ends of the plurality of frame members, the blind cover comprises a plurality of windows each defined by a flap and a coupling seam, the hunting blind transitions between an active state, a transitional state and an inactive state, in the active state, each of the plurality of frame members are disposed relative one another about the one or more pivot joints at an angle between 15 and 180 degrees, and in the inactive state, each of the plurality of frame members are disposed relative one another about the one or more pivot joints at an angle between 0 and 15 degrees, the hunting blind in the inactive state is entirely disposed upon a rear portion surface of a vehicle, and the hunting blind in the active state extends from the rear portion surface to a front portion surface of the vehicle; and a coupling substrate, wherein the plurality of frame members couple to the coupling substrate.

15. The portable hunting blind system of claim 14, wherein the plurality of frame members couple to the coupling substrate via one or more base support members.

16. The portable hunting blind system of claim 14, wherein, when the plurality of frame members support the blind cover while the hunting blind is in the active state, the blind cover comprises a plurality of planar sides.

17. The portable hunting blind system of claim 16, wherein at least three of the plurality of planar sides comprise at least one window of the plurality of windows.

18. The portable hunting blind system of claim 14, wherein the coupling substrate comprises one or more structural elements of an all-terrain vehicle.

19. The portable hunting blind system of claim 14, wherein each of the plurality of frame members comprises at least one horizontal portion coupled between at least two vertical portions, and wherein each of the at least two vertical portions terminate at a pivot joint of the one or more pivot joints.

20. A portable hunting blind system, comprising:

a hunting blind comprising a plurality of frame members supporting a blind cover, wherein:

the blind cover comprises a plurality of windows each defined by a flap and a coupling seam, each of the plurality of frame members terminate at one or more pivot joints, each of the one or more pivot joints comprise a first row of frame member terminal ends of the plurality of frame members rotationally coupled to a second row of frame member terminal ends of the plurality of frame members, each of the plurality of frame members comprises at least one horizontal portion coupled between at least two vertical portions, each of the at least two vertical portions terminate at a pivot joint of the one or more pivot joints, the hunting blind transitions between an active state, a transitional state and an inactive state, in the active state, each of the plurality of frame members are disposed relative one another about the one or more pivot joints at an angle between 15 and 180 degrees, when the plurality of frame members support the blind cover while the hunting blind is in the active state, the blind cover comprises a plurality of planar sides, at least three of the plurality of planar sides comprise at least one window of the plurality of windows, in the inactive state, each of the plurality of frame members are disposed relative one another about the one or more pivot joints at an angle between 0 and 15 degrees, the hunting blind in the inactive state is entirely disposed upon a rear portion surface of a vehicle, and the hunting blind in the active state extends from the rear portion surface to a front portion surface of the vehicle; and a coupling substrate comprising one or more structural elements of an all-terrain vehicle, wherein the plurality of frame members couple to the coupling substrate via one or more base support members.

* * * * *